United States Patent [19]

Laurent

[11] Patent Number: 4,981,152

[45] Date of Patent: Jan. 1, 1991

[54] PORTABLE, FOLDABLE BEACH SCREEN

[75] Inventor: David R. Laurent, Leucadia, Calif.

[73] Assignee: Breeze Busters, Inc., Leucadia, Calif.

[21] Appl. No.: 342,861

[22] Filed: Apr. 25, 1989

[51] Int. Cl.[5] ..... E04H 17/16

[52] U.S. Cl. ..... 135/117; 135/900; 135/87; 256/26

[58] Field of Search ..... 135/117, 87, 900, 902; 160/351, 352; 248/152, 174; 206/223, 217; 40/610, 607; 256/26, 24, 1

[56] References Cited

U.S. PATENT DOCUMENTS

| | | | |
|---|---|---|---|
| D. 236,869 | 10/1973 | Levy | D6/139 |
| D. 236,870 | 10/1973 | Levy | D6/139 |
| D. 237,663 | 10/1973 | Levy | D6/139 |
| 1,778,815 | 10/1930 | Scrivner et.al. . | |
| 1,813,647 | 7/1931 | Uhl . | |
| 1,917,498 | 7/1933 | Collins . | |
| 1,930,404 | 10/1933 | Wagner . | |
| 2,459,928 | 1/1949 | Edwards | 40/610 |
| 2,834,351 | 5/1958 | Garson | 128/377 |
| 2,981,256 | 4/1961 | Besnah | 135/87 X |
| 3,050,067 | 8/1962 | Trafton | 128/372 |
| 3,463,577 | 8/1969 | Friedberg | 128/372 X |
| 3,627,272 | 12/1971 | Friedberg | 135/87 X |
| 3,709,237 | 1/1973 | Smith | 135/87 |
| 3,991,769 | 11/1976 | Paz | 128/372 |
| 4,202,396 | 5/1980 | Levy | 160/107 |
| 4,205,684 | 6/1980 | Lassy | 128/372 |
| 4,311,199 | 1/1982 | Elias | 256/24 X |
| 4,320,744 | 3/1982 | Fodor et al. | 126/450 |
| 4,576,364 | 3/1986 | O'Fearna | 256/24 |
| 4,823,822 | 4/1989 | Maya | 135/19.5 |
| 4,838,525 | 6/1989 | Snow et al. | 135/87 X |

FOREIGN PATENT DOCUMENTS

| | | | |
|---|---|---|---|
| 1326537 | 4/1963 | France | 135/87 |
| 1421937 | 11/1965 | France | 256/24 |
| 530408 | 12/1957 | Italy | 135/87 |

*Primary Examiner*—David A. Scherbel
*Assistant Examiner*—Lan Mai
*Attorney, Agent, or Firm*—Bernard, Rothwell & Brown

[57] ABSTRACT

A portable, foldable beach screen provides privacy and protection from wind and blowing sand for a reclining individual. The screen is constructed from a single panel and is foldable into a compact and easily carried configuration. The screen may include a reflective material on one or both major surfaces and can carry advertising messages or other printing.

1 Claim, 2 Drawing Sheets

PORTABLE, FOLDABLE BEACH SCREEN

BACKGROUND OF THE INVENTION

1. Field of the Invention

The present invention relates to a portable, foldable beach screen which provides privacy and protection from wind and blowing sand for a reclining individual. More specifically, the invention relates to such an apparatus which is constructed from a single panel and is foldable into a compact and easily carried configuration. The screen may include a reflective material on one or both major surfaces and can carry advertising messages or other printing.

2. Background Art

Beachgoers are well aware that even a slight breeze blowing across the sand can be an annoyance for the reclining sunbather. Blowing sand deposited on the individual detracts from the otherwise pleasurable environment, yet is difficult to avoid. The chilling effect of a cool breeze, even absent blowing sand, can be undesirable and uncomfortable as well. Thus, one of the needs in the art is a portable beach screen which functions as a barrier to wind and sand for the reclining sunbather or beachgoer by means of a beach screen which will remain upright in even a substantial breeze.

Beachgoers may also desire a degree of privacy while sunbathing or otherwise reclining and this, too, may be difficult to obtain. Others in the immediate vicinity of the individual may annoy by kicking sand, and a physical barrier between the individual and her annoying neighbors can provide a degree of comfort. There is a need in the art to provide a portable beach screen which functions as a privacy screen for the beachgoer.

Other needs are a beach screen which provides a full body tanning device as well as a vehicle for advertising or other printed messages. These needs are fulfilled by a beach screen which can be manufactured quite inexpensively and thus is highly appropriate as a 'give away' item for businesses located on or near the beach. Advertising slogans or other messages imprinted upon the screen will be highly visible to the beachgoing population. When one or both surfaces of the present beach screen are covered with a highly reflective material, the screen can be employed to reflect the sun's rays upon the sunbather.

A variety of devices intended to protect the beachgoer, and/or to provide a highly reflective surface for suntanning, are found in the prior art. None provide the simple and inexpensive construction and high versatility provided by the present beach screen, however.

U.S. Pat. No. 2,981,256 (Besnah; Apr. 25, 1961) discloses a protective and reflective device for use on the beach. The device is constructed from a plurality of individual panels interconnected by hinges. Thus, the cost to manufacture this device would be substantial.

U.S. Pat. No. 3,463,577 (Friedberg; Aug. 26, 1969) relates to a sun reflecting board adapted to be placed over the head of a sunbather. Although the patent illustrates that the board can be stood up on the sand, the board includes no provision to prevent it from falling over in a breeze. This device does not seem well suited as a screen for blocking wind and blowing sand.

U.S. Pat. No. 1,930,404 (Wagner; Oct. 10, 1933) discloses a privacy screen for beachgoers. Fabric panels are suspended from stakes driven into the sand. This device is not foldable and highly portable.

SUMMARY OF THE INVENTION

The present invention provides a portable and foldable beach screen apparatus comprising a single unitary panel means constructed of a material which is impervious to air flow, the panel means comprising a plurality of panel members foldable about one another from a first, fully folded configuration wherein each of the panel members are juxtaposed over one another to a second, fully deployed position wherein the panel means is of substantially planar configuration, each of said panel members comprising a slot means for engaging a support stake means, and support stake means for supporting the apparatus in the ground, the support stake means passing through said slot means and into the ground.

The inventive beach screen fulfills each of the needs discussed above by providing a lightweight yet sturdy screen which is quite inexpensive to manufacture. One or both major surfaces may be covered with a highly reflective material and may be imprinted with an advertising or other message. The screen can be erected into a variety of configurations and is staked into the ground or sand for security against blowing over. The screen is readily folded into a compact and easy to carry configuration. In this folded configuration the stakes are held within a special tab in one of the panels so that they do not become separated from the screen and lost.

DETAILED DESCRIPTION OF THE INVENTION

Figure 1:
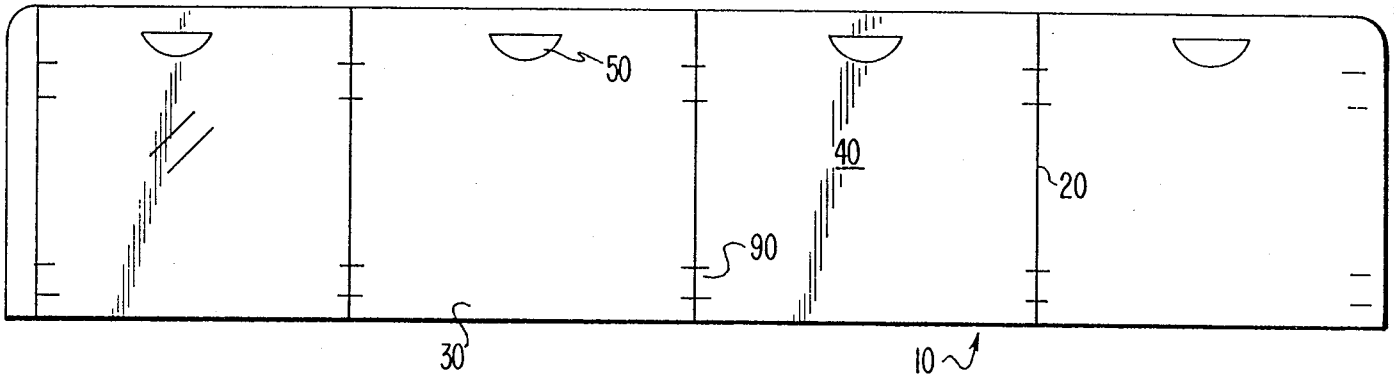
FIG. 1 is a view of the interior side of the present beach screen.

Referring now to FIG. 1, the present portable and foldable beach screen is seen to be comprised of a single, unitary panel 10. Panel 10 can be constructed of any air (and preferably light) impervious lightweight material, so long as the material lends itself to being repeatedly folded and unfolded along fold lines 20. Fold lines 20 are established within the panel 10 during the manufacture of the screen. For example, in my preferred embodiment panel 10 is constructed of two hundred pound test corrugated cardboard. Fold lines 20 are calendared into the panel during the cutting of the same.

Figure 3:
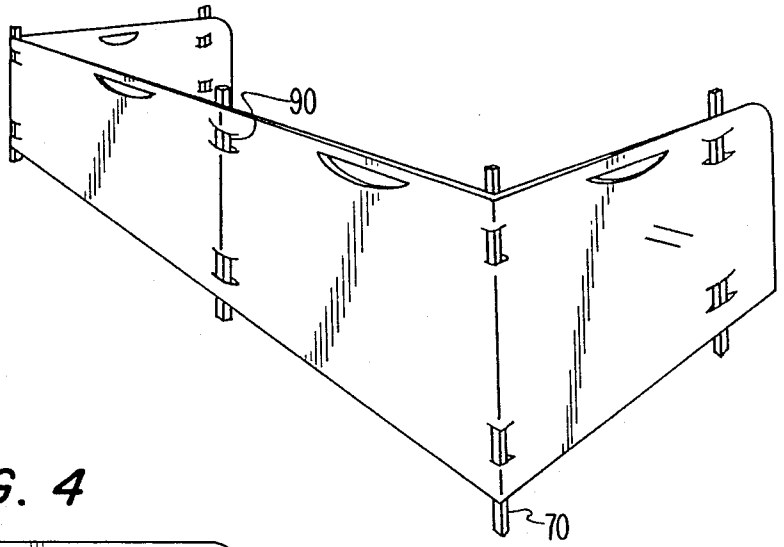
FIG. 3 is a view of the present beach screen in an erected configuration.

As seen in FIG. 1, fold lines 20 serve to subdivide panel 10 into a number of individual panel members 30. These panel members can be angled with respect to one another so that the screen can be erected in a variety of configurations. One such configuration is seen in FIG. 3, and it will be appreciated that many other configurations are possible.

The preferred embodiment which is illustrated in FIG. 1 includes a panel 10 constructed of a unitary piece of corrugated cardboard measuring sixty inches (cm.) long by eighteen inches (46 cm.) high. The panel 10 is subdivided by three fold lines 20 into four panel members 30 of equal size measuring fifteen by eighteen inches (by 12 cm.). It will be apparent that the number and size of the individual panel members can be varied as desired.

The preferred embodiment includes a highly reflective surface material (designated by reference numeral 40 in the Figures) on the inside-facing major surface of panel 10. A thin layer of silver-colored metallic foil is preferred as it provides a high degree of reflectance, and corrugated cardboard coated with such a material is commercially available.

Figure 4:
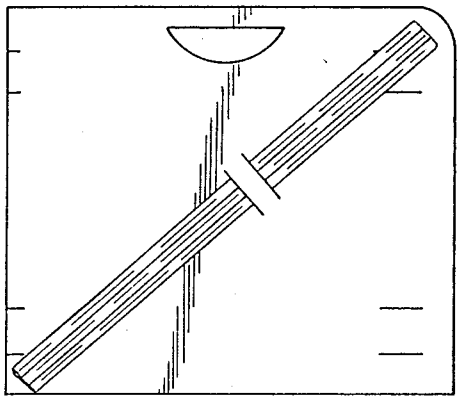
FIG. 4 is a view of the present beach screen in a folded configuration.

It is also seen in FIG. 1 that each of the individual panel members 30 has a handle opening 50 centered along its upper edge. The handle openings are identically placed within each panel member so that they align when the beach screen is folded for carrying. This is best seen in FIG. 4.

Figure 2:
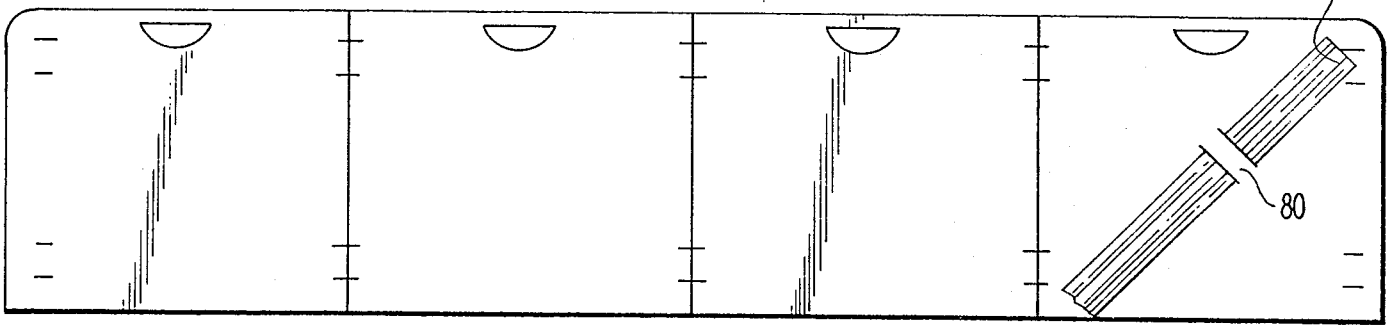
FIG. 2 is a view of the exterior side of the present beach screen.

FIG. 2 illustrates the outer-facing surface 60 of the present beach screen. In the preferred embodiment this surface does not include the highly reflective coating, as reflections from this outer surface could prove distracting and/or annoying to others on the beach. Surface 60 is well suited to carry advertising slogans or messages, and these are most effective when confined to an individual panel member 30 so as not to be rendered unreadable by certain configurations of the beach screen.

The stakes 70 used to secure the screen in the sand or ground are seen in their stored position in FIG. 2. Three stakes are included with the four panel preferred embodiment, and these are stored for carrying by securing them under tab 80 in the end panel. Stakes constructed of either lightweight wood, such as pine, or of plastic, are preferred due to their sturdiness and low cost. The stakes should be somewhat longer than the height of the beach screen so that the lower three to six inches can be driven into the sand or ground, while an upper portion of similar length projects beyond the upper surface of the panel members. As seen in FIG. 4, however, the stakes should be slightly shorter than the diagonal dimension of the panel members so that the stakes do not project beyond the edges of the panel when the screen is in its fully folded configuration. The stakes are tapered at their lower ends in order to facilitate their entry into the ground, but are not so sharp as to present a danger to the consumer.

FIG. 3 shows one of the many ways in which the present beach screen can be erected and secured. As seen in this Figure, stakes 70 are passed through pairs of tabs 90 and then into the sand or ground. Again, it will be appreciated that many other configurations are possible. Also, two or more beach screens can be combined to erect longer or larger barriers or privacy screens.

The ability to fold the screen into a compact, easily handled configuration is a key feature of the present invention. FIG. 4 illustrates this configuration; the folded unit has the dimensions of one of the individual panel members, and the stakes are secured within their tab in the end panel member to prevent their loss.

Although the present portable and foldable beach screen has been described and illustrated in connection with certain preferred features and embodiments, it is not limited thereto. Numerous modifications within the scope of the following claims will be apparent.

I claim:

1. A portable and foldable beach screen apparatus comprising:

a single unitary panel means constructed of a material which is substantially impervious to air flow, the panel means comprising a plurality of panel members foldable about one another from a first, fully folded configuration wherein each of the panel members are juxtaposed over one another to a second, fully deployed position wherein the panel means is of substantially planar configuration, each of said panel members comprising a tab means for engaging a support stake means, support stake means for supporting the apparatus in the ground, the support stake means adapted to pass through said tab means and into the ground, and an end panel having therein a storage slot means for securing the stake means to the end panel when said apparatus is in said fully folded configuration.

* * * * *